US006846979B2

(12) United States Patent
Kondo

(10) Patent No.: US 6,846,979 B2
(45) Date of Patent: Jan. 25, 2005

(54) MUSICAL PERFORMANCE DATA SEARCH SYSTEM

(75) Inventor: Masao Kondo, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/080,357

(22) Filed: Feb. 20, 2002

(65) Prior Publication Data

US 2002/0112596 A1 Aug. 22, 2002

(30) Foreign Application Priority Data

Feb. 20, 2001 (JP) ..... 2001-044167

(51) Int. Cl.[7] ..... A63H 5/00; G04B 13/00; G10H 7/00

(52) U.S. Cl. ..... 84/609; 84/610; 84/615; 84/634; 84/649; 84/650; 84/653

(58) Field of Search ..... 84/600–602, 609–613, 84/615, 617–618, 634–637, 649–653, 655–656, 477 R

(56) References Cited

U.S. PATENT DOCUMENTS 5,286,907 A * 2/1994 Okamura et al. ..... 434/307 A
5,895,876 A * 4/1999 Moriyama et al. ..... 84/609
5,918,303 A * 6/1999 Yamaura et al. ..... 84/609
6,232,539 B1 * 5/2001 Looney et al. ..... 84/609
6,248,946 B1 * 6/2001 Dwek ..... 84/609

FOREIGN PATENT DOCUMENTS

JP 10-207460 8/1998

* cited by examiner

*Primary Examiner*—Marlon Fletcher
(74) *Attorney, Agent, or Firm*—Rossi & Associates

(57) ABSTRACT

A search list of records is displayed on a display screen DP. Some records may have the same music title as one item, but are different in other items (genre, rhythm, tempo and the like). A favorite list can be formed by a selection process using a mark FMa (reversible by a favorite switch ST0) on each record. A first or second list can be formed by a search process after a search switch SM5 or ST5 is operated. A desired list is selected by using list selection switches ST1 to ST4 and a desired record is designated by a cursor CR to decide a style. The cursor CR can be moved by one record after another by a normal cursor motion switch SM2 or SM3, and jumped to a record group having different item contents by a special cursor motion switch SM1 or SM4.

15 Claims, 11 Drawing Sheets

FIG.4

| |
|---|
| IDENTIFICATION NUMBER |
| STYLE NUMBER SN |
| MUSIC TITLE |
| GENRE NAME |
| RHYTHM |
| TEMPO |
| KEYWORD |
| FAVORITE FLAG FF |

FIG.3

| |
|---|
| STYLE NUMBER SN |
| INTRODUCTION DATA |
| MAIN DATA |
| FILL-IN DATA |
| ENDING DATA |

FIG.6A

| | MUSIC | STYLE | GENRE | RHYTHM | TEMPO |
|---|---|---|---|---|---|
| ○ | AAAAA | STYLE A | POP | 4/4 | 120 |
| ● | AAAAA | STYLE B | JAZZ | 4/4 | 100 |
| ○ CR | BBBBB | STYLE B | JAZZ | 4/4 | 120 |
| ○ FMn | AAAAA | STYLE C | ROCK | 3/4 | 80 |
| ● FMa | CCCCC | STYLE C | ROCK | 3/4 | 100 |

FIG.6B

| | MUSIC | STYLE | GENRE | RHYTHM | TEMPO |
|---|---|---|---|---|---|
| ○ | AAAAA | STYLE A | POP | 4/4 | 120 |
| ● | AAAAA | STYLE B | JAZZ | 4/4 | 100 |
| ○ CR | BBBBB | STYLE B | JAZZ | 4/4 | 120 |
| ○ | AAAAA | STYLE C | ROCK | 3/4 | 80 |
| ● | CCCCC | STYLE C | ROCK | 3/4 | 100 |

FIG.6C

| | MUSIC | STYLE | GENRE | RHYTHM | TEMPO |
|---|---|---|---|---|---|
| ○ | AAAAA | STYLE A | POP | 4/4 | 120 |
| ● | AAAAA | STYLE B | JAZZ | 4/4 | 100 |
| ○ | BBBBB | STYLE B | JAZZ | 4/4 | 120 |
| ○ | AAAAA | STYLE C | ROCK | 3/4 | 80 |
| ● | CCCCC | STYLE C | ROCK | 3/4 | 100 |

CR

FIG.6D

| | MUSIC | STYLE | GENRE | RHYTHM | TEMPO |
|---|---|---|---|---|---|
| ○ | AAAAA | STYLE A | POP | 4/4 | 120 |
| ● | AAAAA | STYLE B | JAZZ | 4/4 | 100 |
| ○ | AAAAA | STYLE C | ROCK | 3/4 | 80 |

CR

MUSICAL PERFORMANCE DATA SEARCH SYSTEM

CROSS REFERENCE TO RELATED APPLICATION

This application is based on and claims priority of Japanese patent application No. 2001-044167, filed on Feb. 20, 2001, the whole contents of which are incorporated herein by reference.

BACKGROUND OF THE INVENTION

A) Field of the Invention

The present invention relates to a musical performance data search system, and more particularly to a musical performance data search system having a related data editing function.

B) Description of the Related Art

A user of an automatic musical performance apparatus plays only a melody line, and makes the automatic musical performance apparatus play style data (hereinafter simply called a "style") which is accompaniment data stored in the automatic musical performance apparatus, by searching and designating the style by using the apparatus.

Accompaniment which matches a melody line is generally selected by a user. In this case, the user selects the style in accordance with related data such as genres of music programs listed on a display device.

Performance data to be set to music includes tone color data and accompaniment data (or simply called a "style"). The performance data is used together with an information group "records" such as a music title and a music genre which represents the image of the music. A conventional apparatus capable of easily selecting such performance data is disclosed, for example, in JP-A-10-207460. This apparatus displays a list of a plurality of records to allow a user to select the performance data such as tone color data and style.

This conventional apparatus displays only one style per one music title in the list. Only one list is prepared for searching a style. When record search starts, the list of all records is displayed to allow a user to narrow a search range of records under the desired search conditions.

Therefore, with the conventional apparatus of this type, it is not possible to know a variety of styles matching one music title and to select the optimum style from a plurality of style candidates. Narrowing the search range of all records and reducing the amount of displayed contents are a time consuming work. With such a conventional apparatus, it takes a long time to narrow the search range and find a desired style.

With the conventional apparatus, a cursor is moved one data item after another of a list displayed on the display unit. It takes a time to move the cursor to the desired data item.

SUMMARY OF THE INVENTION

It is an object of the present invention to provide a performance data search system capable of easily and quickly searching and selecting performance data desired by a user from a plurality set of performance data such as a variety of styles.

According to one aspect of the present invention, there is provided a performance data search system comprising: performance data storage storing performance data settable to music; presenting device which presents a group of records stored in the performance data storage; and data reader which reads the performance data corresponding to a record selected from the presented group of records, wherein each record contains a music title, and different performance data are associated with a plurality of records having same music title.

According to another aspect of the invention, there is provided a performance data search system comprising: performance data storage storing performance data settable to music; presenting device which presents a group of predetermined records stored in the performance data storage; and data reader which reads the performance data corresponding to a record selected from the presented group of records.

According to still another aspect of the invention, there is provided a performance data search system comprising: performance data storage storing performance data settable to music; presenting device which presents in a list format a group of records stored in the performance data storage; a first operation unit for selecting next record in the order of records in the list; a second operation unit for selecting a record having different contents in a particular item of the record, in the order of records in the list; and data reader which reads performance data corresponding to a record selected by the first or second operation unit.

In a musical performance data search system of the invention using a database storing performance data settable to music, a plurality of record groups in the database are presented from which desired performance data (style data) corresponding records is read. Each record contains a music title, and a plurality of records having the same music title are assigned different performance data (a combination of genre, rhythm and tempo).

BRIEF DESCRIPTION OF THE DRAWINGS

FIG. 3 is a diagram showing an example of the configuration of a style according to the embodiment.

FIG. 4 is a diagram showing an example of the configuration of a record according to the embodiment.

FIGS. 6A, 6B, 6C and 6D are schematic front views showing examples of a list display panel according to the embodiment.

DESCRIPTION OF THE PREFERRED EMBODIMENTS

Embodiments will be detailed with reference to the accompanying drawings. The embodiments are only illustrative and not limitative. Various modifications are possible.

[Hardware Configuration]

Figure 1:
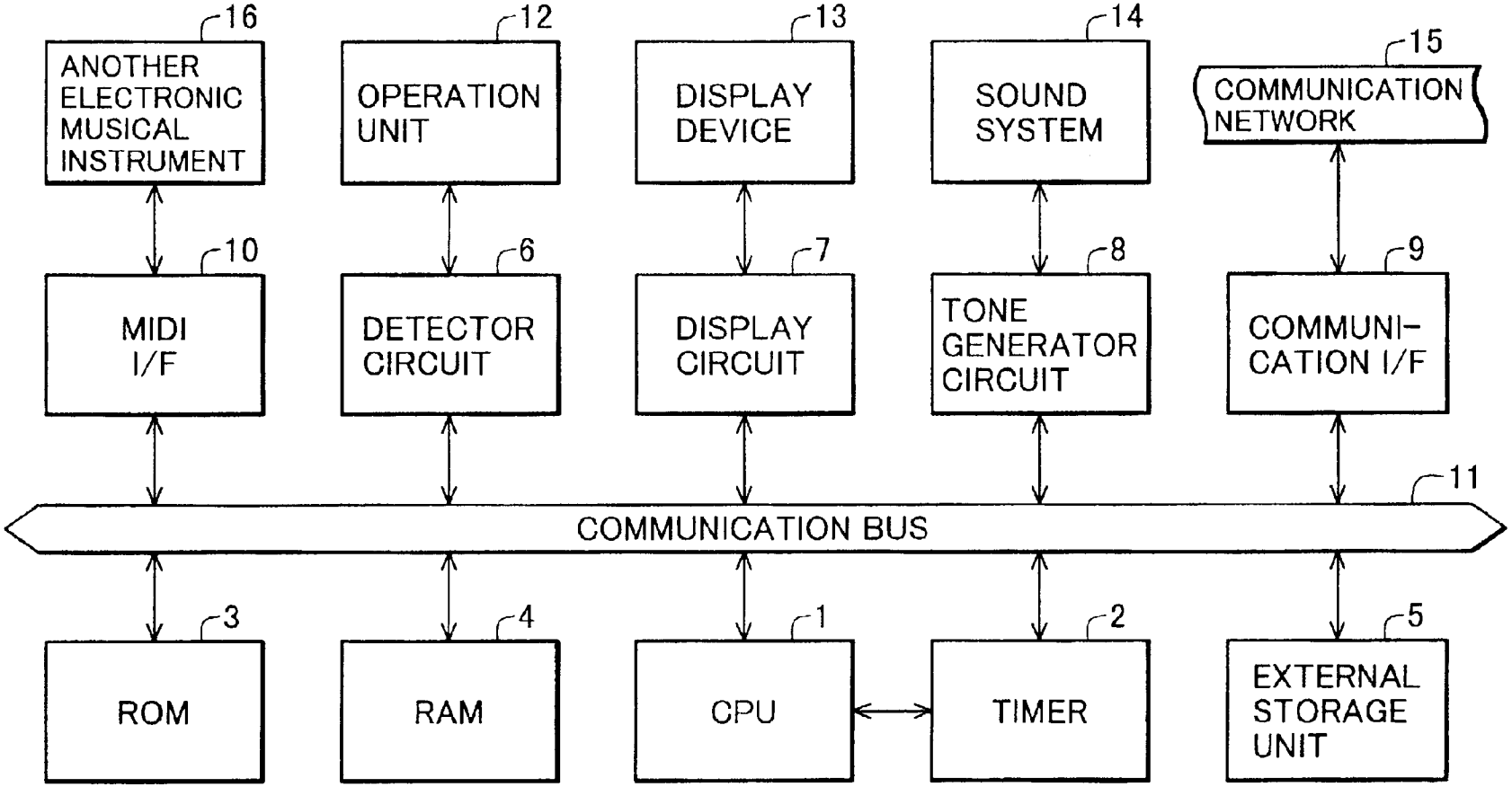
FIG. 1 is a block diagram showing the hardware structure of a performance data search system according to an embodiment of the invention.

FIG. 1 shows the hardware configuration of an electronic musical instrument equipped with a musical performance data search system. This electronic musical instrument can be installed with various software and can execute a performance data search process called "style search". The electronic musical instrument has a central processing unit (CPU) 1, a timer 2, a read-only memory (ROM) 3, a random access memory (RAM) 4, an external storage unit 5, a detector circuit 6, a display circuit 7, a tone signal generator 8, a communication interface (I/F) 9, a MIDI interface (I/F) 10 and the like, respectively interconnected by a communication bus 11.

CPU 1 for controlling the whole electronic musical instrument performs various controls in accordance with a predetermined software program and clocks supplied from the timer 2. CPU 1 performs a usual performance data process in accordance with performance data played by a user or performance data supplied from another electronic musical instrument and particularly a performance data (style) search process of searching style data. ROM 3 stores predetermined control programs for controlling the electronic musical instrument. These programs include various programs for executing the fundamental performance data process and performance data search process. ROM 3 also stores various tables and data necessary for these processes. For example, a plurality set of style data are stored in a style database (DBS), and a plurality of records are stored in a record database (DBR).

RAM 4 stores flags and buffers to be used for executing the processes. For example, RAM 4 temporarily stores search condition data such as favorite flag (FF) update data and search condition buffer (BF1, BF2) data, and search list data such as data of a favorite list (LSF) and search lists (LS1, LS2). RAM 4 also stores read buffer data for automatic accompaniment. The read buffer is used for temporarily storing style data for automatic accompaniment.

The external storage unit 5 may be a hard disc (HD) and/or a compact disc read-only memory (CD-ROM), a floppy disk (FD), a magneto optical (MO) disc, a digital versatile disc (DVD) and/or a memory card. The external storage unit 5 stores various control programs and various data. For example, programs and various databases necessary for the performance data search process may be stored in ROM 3, or read from the external storage unit 5 into RAM 4. The process results (such as favorite flag data) may be stored in the external storage unit 5 when necessary. In the latter case, the style data may be added and version-up of programs becomes easy.

An operation unit 12 is connected to the detector circuit 6. The operation unit 12 has performance operation units such as a musical performance keyboard, switches and dials, as well as panel operation units on an operation panel of the apparatus to be used for various settings. The panel operation units include a plurality of screen operation switches (SM0 to SM5, ST0 to ST5) of a multi-functional type whose function changes with an operation mode, and a style reproduction switch for starting (stopping) automatic accompaniment. These operation units may be of any type so long as they can enter information.

A display device 13 connected to the display circuit 7 includes a display panel (DP) and various indicators provided in the operation panel. The display panel (DP) can display various search lists and search windows as well as a cursor (CR), a pop-up input window and various indication marks respectively operated by the panel operation units.

The tone generator circuit 8 is connected to a sound system 14 including an effect circuit made of a digital signal processor (DSP) and the like, and speakers. The sound system 14 can reproduce musical sounds by reading performance data stored in RAM 4 or the like. The communication I/F 9 is connected to a communication network 15 such as a local area network (LAN), the Internet and a telephone line. Control programs, performance data and the like can be downloaded in the external storage unit 5 from a server computer or the like via the communication network 15.

A performance data processing apparatus 16 such as another electronic musical instrument is connected to MIDI I/F 10 to receive performance data of the MIDI format. In FIG. 1, the electronic musical instrument having the performance data search system is shown. The performance data search system may be configured by a personal computer (PC) terminal. The electronic musical instrument may be of any type such as a percussion type, a keyed type, a wind type, and a stringed type.

[Example of Performance Data Configuration]

Figure 2:
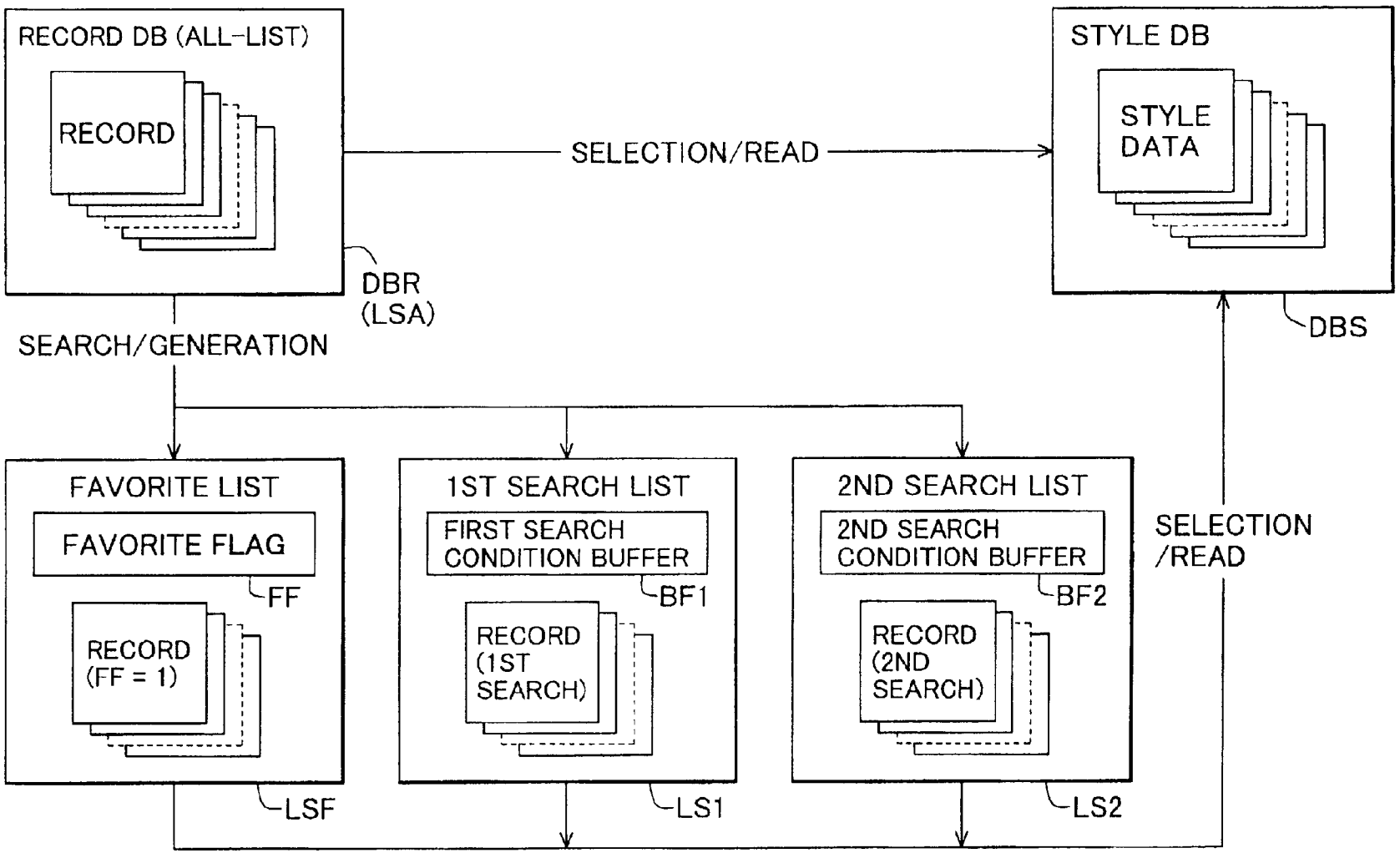
FIG. 2 is a diagram showing the configuration of stored data according to the embodiment.

FIG. 2 is a diagram showing the configuration of stored data in the performance data search system. The style database (DBS) and record database (DBR) are configured in ROM 3, RAM 4 or external storage unit 5. The style database DBS stores beforehand a plurality set of style data, and the record database DBR stores beforehand auxiliary data for searching a plurality set of style data called "records".

The style database DBS stores a plurality set of style data constituted of automatic accompaniment performance data. The style data is automatic accompaniment performance data of a plurality of sections, as well known. For example, as shown in FIG. 3, the style data is constituted of data in each section, such as "introduction data", "main data", fill-in data" and "ending data" set under a "style number SN". The "style number SN" is a number unique to the style data for identifying each style data. A style name is also given to each style data.

The "introduction data" is automatic accompaniment performance data of one to several measures optimum to the head part of music. The "main data" is automatic accompaniment performance data of one to several measures optimum to the intermediate part of music. The "fill-in data" is automatic accompaniment performance data of one to several measures optimum to the section change part between introduction, main and ending data. The "ending data" is automatic accompaniment performance data of one to several measures optimum to the ending part of music.

The record database DBR stores a plurality of records which are auxiliary data constituted of data necessary for searching style data. These "records" constitute a variety of search lists such as an all-list LSA, a favorite list LSF, a first search list LS1 and a second search list LS2. By using these lists, style data to be read can be searched with ease.

The "record" stores the correspondence information between various data used for a user to imagine music to be performed and style data optimum to accompaniment to the music. For example, as shown in FIG. 4, the record is constituted of various setting information such as "music title", "genre name", "rhythm", "tempo" and "keyword" respectively set under "identification number" and "style number SN". The record also has the "favorite flag FF".

The "identification number" is a number unique to each record for identifying the record. The "style number SN" stores in its field one style number of style data optimum to accompaniment to music represented (imagined) by various setting information of the record. The same style number SN may be stored in a plurality of records.

The setting information is used for a user to imagine the style data optimum to accompaniment to music. The "music title" stores in its field one music title. The "genre name" stores in its field one genre name of music. The "rhythm" stores in its field one rhythm of music. The "tempo" stores in its field one tempo of music. The "keyword" stores in its field a plurality of keywords capable of making a user to image music. The number of records provided to music having the same music title is not limited. A composer, an artist and the like in addition to the music title may be stored to facilitate a selection of music.

The "favorite flag FF" indicates whether the record is to be added to the favorite list LSF (FF value="1") or not (FF value="0").

Referring to FIG. 2, the "all-list LSA" (list A) is a search list storing all records recorded in the record database DBR. By using the all-list LSA, all records recorded in the record database DBR are displayed on the display panel DP of the display device 13. When a user selects a desired record from this list, the optimum style data can be read from the style database DBS by using the style number of the selected record as a search key.

The "favorite list LSF" is a search list storing records which are instructed to be added to the favorite list (satisfy the favorite list conditions that the favorite list flag FF value is "1") among all the records. When it is instructed to display the favorite list LSF, the records having the favorite flag FF value of "1" are derived from all the records in the record database DBR and the favorite list LSF is generated. The specific contents of the records used by the favorite list LSF are, therefore, temporarily derived (generated) while the favorite list is displayed.

By storing the record search conditions in the search buffer (search condition buffer) and by searching the records satisfying the search conditions, it is possible for the user to temporarily generate one to more search lists. As examples of these search lists, FIG. 2 shows a "first search list LS1" (list S1) and a "second search list LS2" (list S2).

The lists LS1 and LS2 are the search lists constituted of the records which satisfy the search conditions stored in the first and second search condition buffers BF1 and BF2, respectively. When it is instructed to display the first or second search list LS1 or LS2, the records satisfying the search conditions stored in the first or second search condition buffer BF1 or BF2 are derived to generate the first or second search list LS1 or LS2. The specific contents of the records used by the first or second search list LS1 or LS2 are, therefore, temporarily derived (generated) while the first or second search list is displayed. If there is any space in the memory capacity, data once generated may be stored.

Information of the records constituting the first or second search list is stored in RAM 4 only while the list is displayed. The search conditions already stored in the first and second search condition buffers BF1 and BF2 are maintained stored until new search conditions are input.

After the favorite list LSF, first or second search list LS1 or LS2 is generated by deriving the records satisfying the favorite conditions (FF="1") or first or second search conditions from all the records in the record database DBR, the records belonging to one of the search lists LSF, LS1 and LS2 are displayed on the display device 13. By using as a search key the style number of the record selected from the list, the optimum style data can be selectively read from the style database DBS.

[List Display Area]

Figure 5:
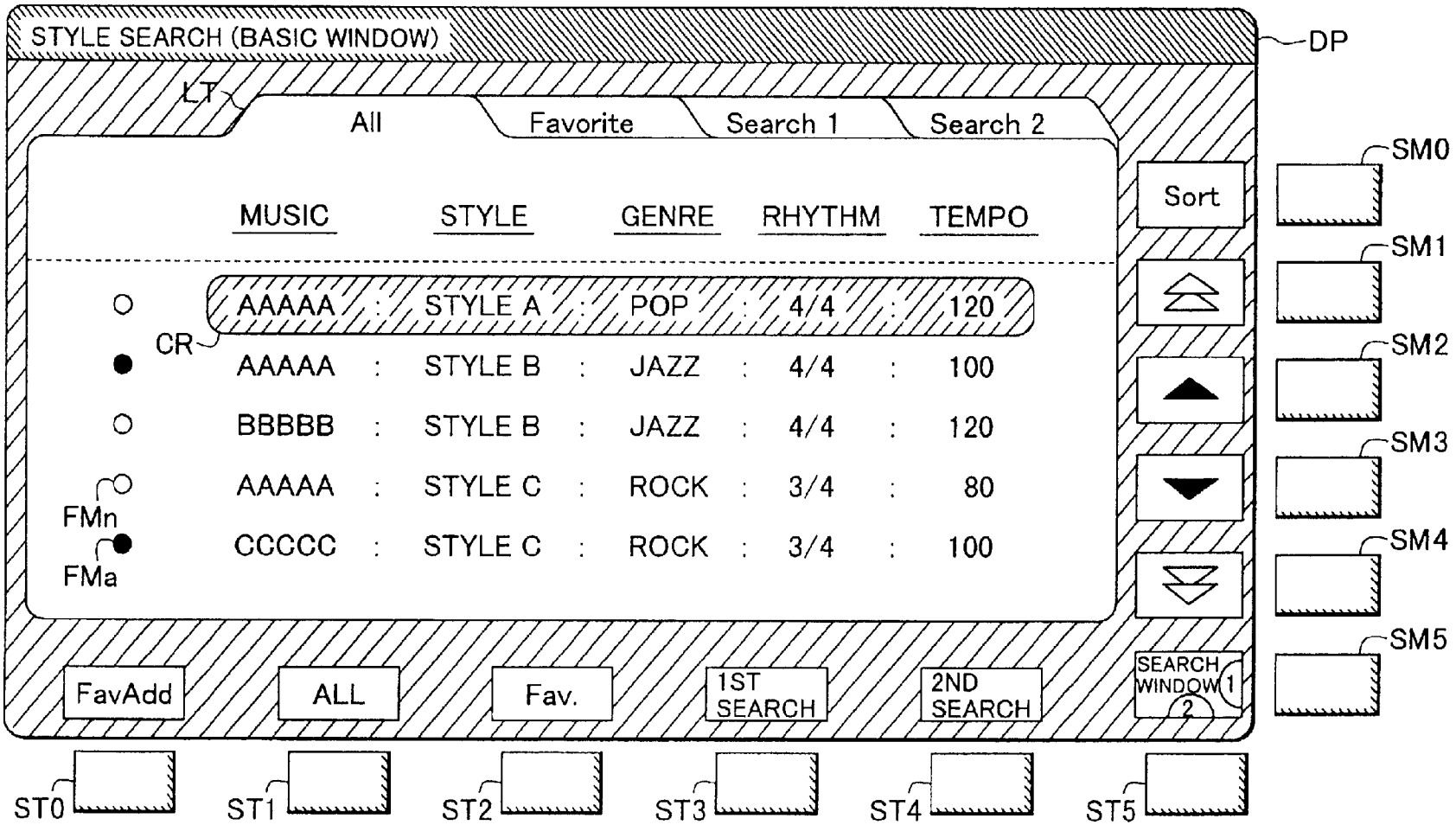
FIG. 5 is a schematic front view showing an example of the correspondence between a display window (basic window) on a display panel and the functions of display operation switches according to the embodiment.

FIG. 5 shows an example of the correspondence between a display window on a display panel and the functions of display operation switches. In the style search process, the display panel DP of the display device 13 of the performance information search system of the electronic musical instrument is used as a list display field for displaying a basic window for various search lists. For example, when the style search function starts, the basic window of "all-list" is displayed on the display panel DP as shown in FIG. 5. Tabs LT in the basic window are used for selecting a desired list from the all-list ("All"), favorite list ("Favorite"), first search list ("Search 1") and second search list ("Search 2"). A frame with oblique lines in the central area of the display screen is the cursor CR for selecting each record.

The switches (display operation switches) SM0 to SM5 and ST0 to ST5 provided near the display panel DP are used as list operation switches for operating the basic window function areas displayed on the display panel DP. In order to facilitate the operation of the list operation switches, marks for guiding the operations of the list operation switches SM0 to SM5 and ST0 to ST5 are displayed near respective list operation switches.

More specifically, in the list display mode for the style search function, the operation switches SM2 and SM3 are used as up and down normal cursor motion switches, respectively. The operation switches SM1 and SM4 are used as up and down special cursor motion switches. The operation switch SM0 is used as a sort switch for changing the display order of records in the list in accordance with a predetermined rule. The operation switch ST0 is used as a "favorite addition" (FavAdd) switch.

The operation switches ST1 to ST4 correspond to the list selection tabs LT and are used as selection switches for the "all-list", "favorite list", "first search list" and "second search list", respectively. The operation switches SM5 and ST5 are used as "search window" display instruction switches for the first and second search lists, respectively.

The operation of the performance data search system will be briefly described with reference to FIG. 5. Each row of each search list (e.g., all-list) on the display panel DP indicates a record. Each record has a plurality of items. Records having the same music title may have different other items (such as "genre", "rhythm" and "tempo"). As the number of records having the same music title is increased, a range of style selection can be broadened. The favorite list can be formed from the all-list by selecting the record having a mark FMa which can be reversed to a mark FMn by using the favorite switch ST0. The first or second search list can be formed by the search process after the search switch SM5 or ST5 is operated. By forming a characteristic list, favorite information of the user can be located easily. A desired list is selected and displayed by using the list selection switches ST1 to ST4, and a desired record is designated by moving the cursor CR on the displayed list to decide the style. The cursor CR can be moved one record after another by using the normal motion switches SM2 and SM3, or can be jumped to a record group having a different genre item by using the special motion switches SM1 and SM4.

FIGS. 6A to 6D are diagrams showing display examples of a list displayed on the display panel (list display panel) of the display device of the performance data search system. In the list display mode, one record is displayed in one row on the list display panel DP of the display device 13. One record contains items (music title, style, genre and the like) disposed in one row along the horizontal direction. The record with the cursor CR is a record presently selected.

In the display item column along the vertical direction, the setting information such as shown in the record configuration of FIG. 4 is shown. In the example shown in FIG. 6A, in the display item "music title" column, the music titles of the records such as "AAAAA" are displayed. In the "style"

column, the style names corresponding to the style numbers NB such as "style A" are displayed. In the "genre" column, the genre names such as "pop" are displayed. In the "rhythm" and "tempo" columns, rhythms and tempos such as "4/4" and "120" corresponding to "rhythm" and "tempo" setting information are displayed.

A circle symbol at the left end of each row is a favorite mark indicating whether or not the record is added to the favorite list LSF. The favorite addition mark FMa represented by the black circle indicates that the record is added to the favorite list (the record has the favorite flag FF of "1"). The favorite non-addition mark FMn represented by the while circle indicates that the record is not added to the favorite list (the record has the favorite flag FF of "0"). In order to add a record to the favorite list, the cursor is moved to this record and the favorite addition (FavAdd) switch ST0 is operated to change the favorite flag FF of the record to "1".

FIG. 6A shows an example of the all-list which displays all the records in the record database. In this all-list LSA, the record in the second row is presently selected which has the music title "AAAAA" and the style name "style B". As shown in the "music title" and "style" columns of FIG. 6A, the record database DBR stores a plurality of records having the same music title (e.g., "AAAAA") or the same style number SN (e.g., "style B" and "style C").

The cursor CR can be moved one record after another in the upward or downward direction in the list each time the up or down normal cursor motion switch SM2 or SM3 is operated. For example, in the display state shown in FIG. 6A, as the down normal cursor motion switch SM2 is operated once, the display state becomes as shown in FIG. 6B.

The cursor CR can be moved to the nearest record having a different genre each time the up or down special cursor motion switch SM1 or SM4 is operated. For example, in the display state shown in FIG. 6A, as the down special cursor motion switch is operated once, the display state becomes as shown in FIG. 6C.

In this embodiment, a search list of records searched under the search conditions set by a user can be displayed. Under the search conditions that the record having the music title "AAAAA" is searched from the all-list LSA, a search list (first search list LS1) can be displayed as shown in FIG. 6D. For example, if the search conditions that "the record having the music title AAAAA is searched from the all-list LSA" are loaded in the first search condition buffer BF1 (FIG. 2) in RAM 4, the first search list LS1 shown in FIG. 6D can be displayed as the search results. In this case, information of the searched records is stored in the first search list storage field in RAM 4 only while the first search list LS1 is displayed. The search conditions set by the user are maintained in the first search condition buffer BF1 until new first search conditions are set.

[Style Search Function}

Figure 7A:
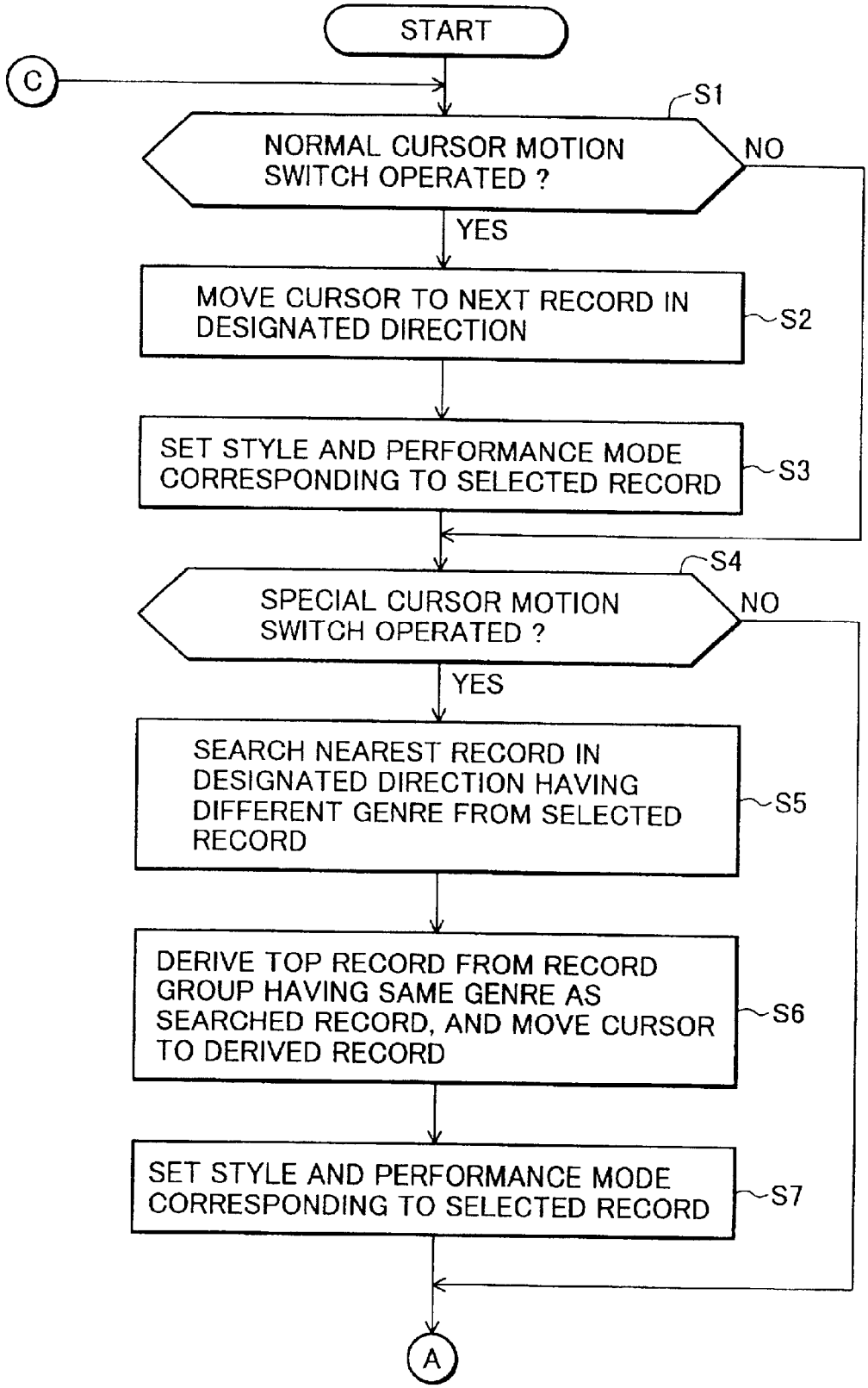
FIGS. 7A, 7B and 7C are flow charts illustrating the operation of a performance data search process according to the embodiment.
Figure 7B:
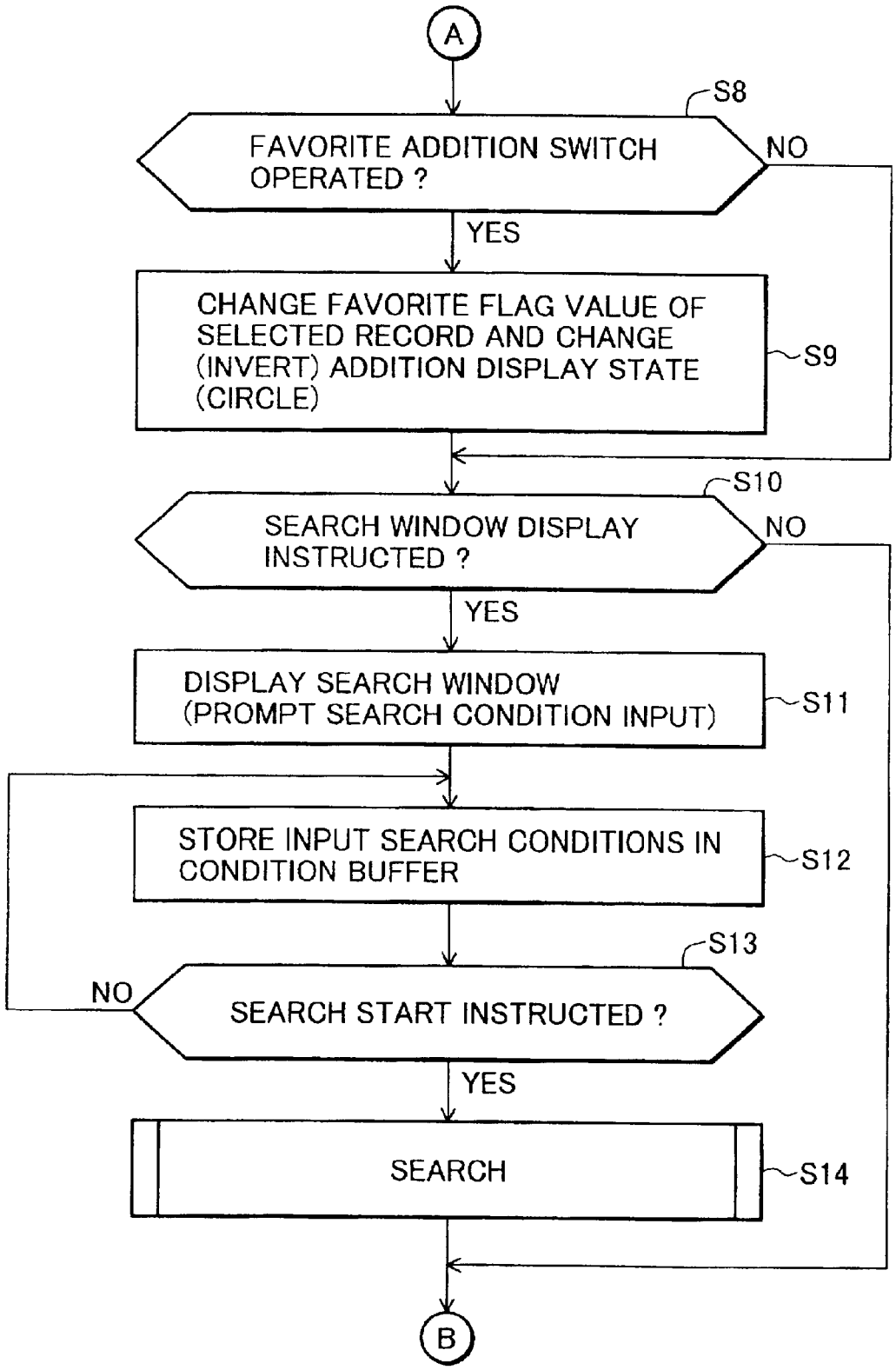
Figure 7C:
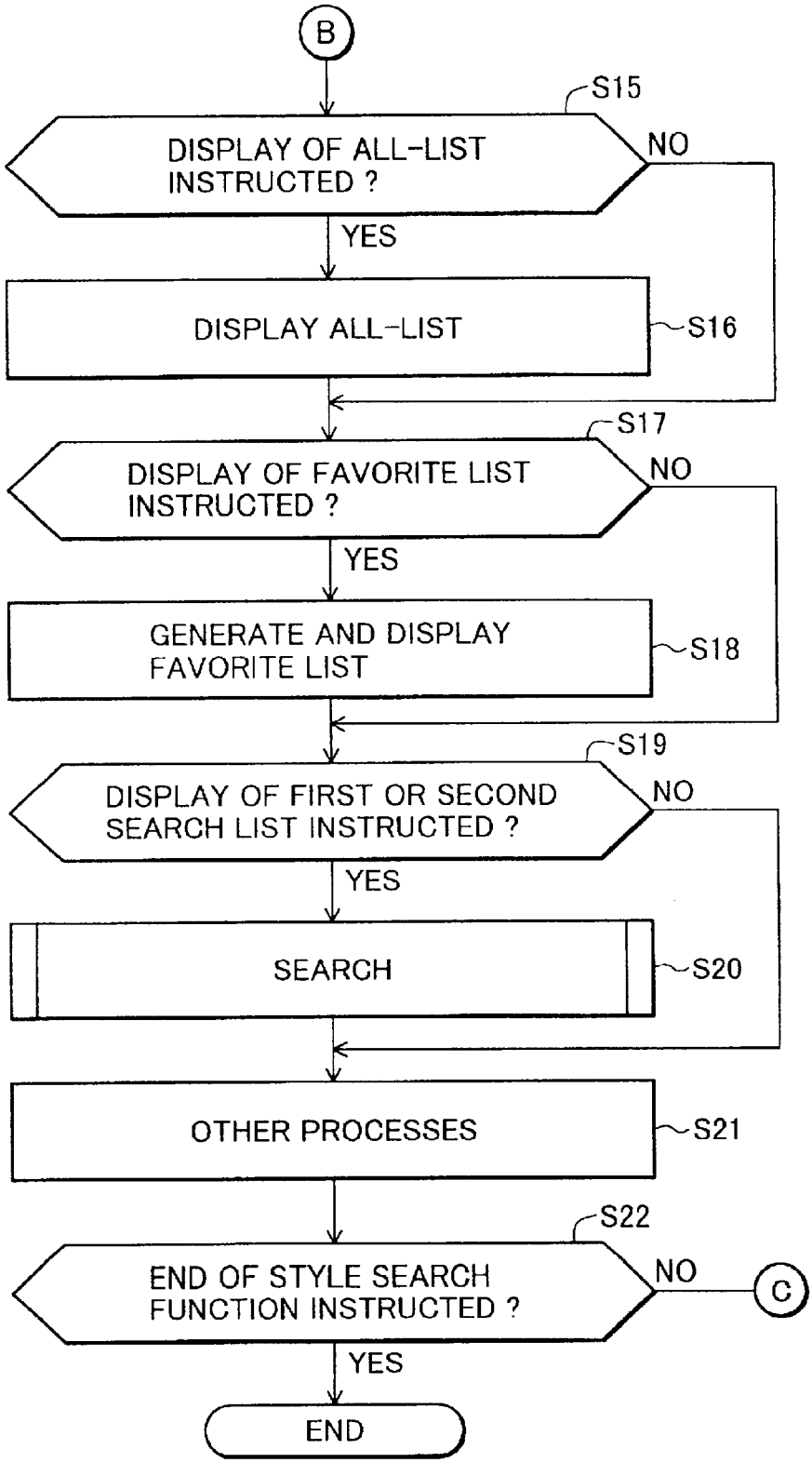

The style search function of the performance data search system is activated only during the period from an activation start instruction to an activation end instruction. FIGS. 7A to 7*c* are flow charts illustrating an example of a style search process to be realized by the style search function. FIG. 7A illustrates mainly a "cursor motion" process, FIG. 7B illustrates mainly a "list generation" process, and FIG. 7C illustrates mainly a "list change" process.

Figure 8:
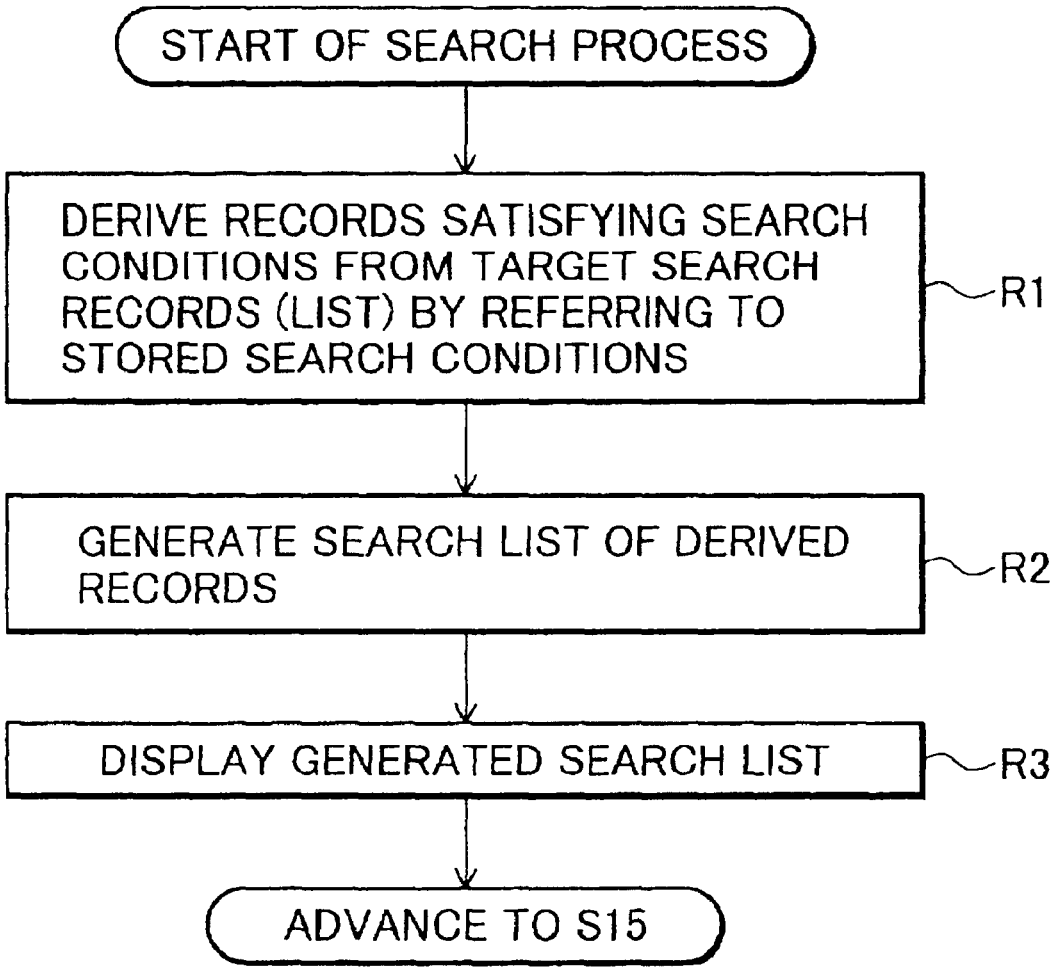
FIG. 8 is a flow chart illustrating a search process according to the embodiment.
Figure 9:
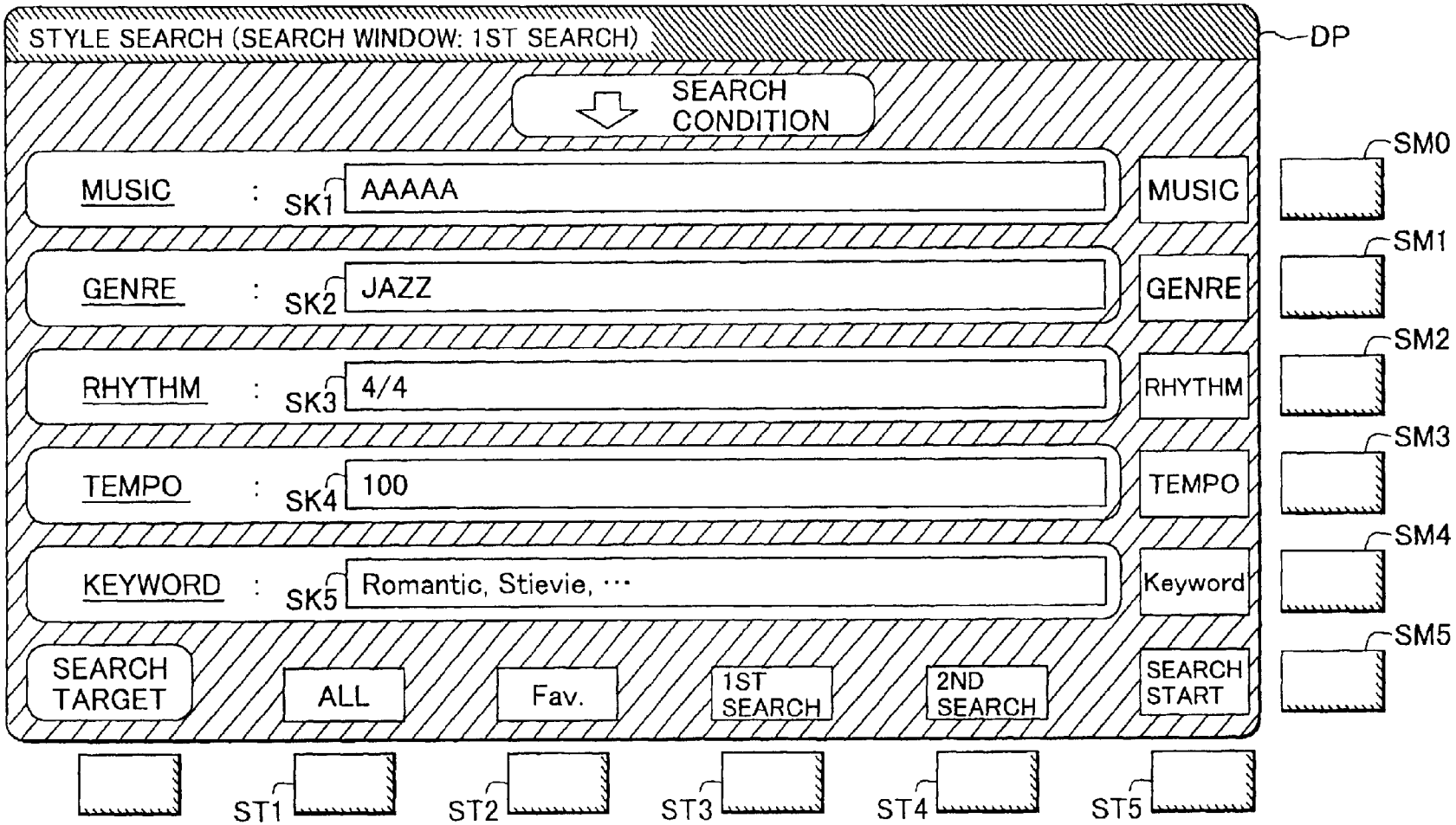
FIG. 9 is a schematic front view showing an example of the correspondence between a display window (search window) on the display panel and the functions of screen operation switches according to the embodiment.

FIG. 8 is a flow chart illustrating a search routine in the style search process, and FIG. 9 shows an example of the correspondence between the display window (search window) on the display panel and the functions of display operation switches (search operation switches) in the search mode.

[1] Cursor Motion

As the style search function is activated, the style search process shown in FIGS. 7A to 7C starts. When this style search process starts, the mode enters a list display mode and the all-list LSA shown in FIG. 5 is displayed in the basic window on the list display panel DP of the display device 13. Thereafter, the cursor motion process illustrated in FIG. 7A is executed.

At the first Step S1 of the style search process, it is judged whether the up or down normal cursor motion switch SM2 or SM3 is operated. If the switch is operated, at Step S2 the cursor CR is moved to the next upper or lower record. For example, in the state shown in FIG. 5, when the down normal cursor motion switch SM3 is operated, the cursor display state becomes as shown in FIG. 6A. As the switch SM3 is again operated, the display state shown in FIG. 6A becomes as shown in FIG. 6B.

After the cursor CR is moved to the new record at Step S2, the record in the row designated by the cursor CR is selected. At Step S3 the style and performance mode corresponding to the selected record are set to the system. As the performance mode is set, the tempo in the selected record is set to an automatic accompaniment apparatus of the electronic musical instrument as an accompaniment reproduction tempo. As the style is set, the style number SN of the selected record is referred to, and the style data corresponding to the style number SN is read from the style database DBS and written in an automatic accompaniment data read buffer in RAM 4 to prepare for style data reproduction.

After the style and performance mode corresponding to the newly selected record are set, the flow advances to Step S4. If the normal cursor motion switches SM2 and SM3 are not operated at Step S1, the flow skips to Step S4.

At Step S4 it is judged whether the up or down special cursor motion switch SM1 or SM4 is operated. If operated, at Step S5 the nearest record in the designated direction having a genre different from that of the presently selected record is searched. At the next Step S6 the top record in a record group having the same genre as the searched record is derived to move the cursor to the derived record. Namely, as the special cursor motion switch SM1 or SM4 is operated, the cursor is not moved to the next record, but it is jumped to the record having a genre different from that of the presently selected record.

For example, in the state shown in FIG. 6A, the genre of the presently selected record in the second row is "jazz". If the down special cursor motion switch SM4 is operated, the record in the forth row having a genre "rock" different from a genre "jazz" and at the nearest position in the "down" direction designated by the switch SM4 is searched. This record is a top record in a record group having the genre "rock". The cursor CR is therefore moved to the record in the fourth row and the cursor display state changes as shown in FIG. 6C.

In the state that the record in the fourth row having the genre "rock" is selected as shown in FIG. 6C, if the up special cursor motion switch SM1 is operated, the record in the third row having a different genre "jazz" and at the nearest position in the "up" direction designated by the switch SM1 is searched. Next, the record in the second row is derived as the top record in a record group having the same genre "jazz" as that of the third row record, and the cursor CR is moved to the second row record. The cursor display state becomes as shown in FIG. 6A.

After the cursor CR is moved to the new record and the record in the row designated by the cursor CR is selected at Step S6, the style and performance mode corresponding to the selected record are set to the system at Step S7, similar to Step S3. After the style and performance mode corresponding to the newly selected record are set, the flow advances to Step S8 (FIG. 7B). If the special cursor motion switch SM1 or SM4 is not operated at Step S4, the flow skips from Step S4 to Step S8.

At Step S8 it is judged whether the favorite addition switch ST0 (FIG. 5) is operated. If operated, at Step S9 the value of the favorite flag FF of the record selected by the cursor CR is changed and the display state of the favorite mark is changed (reversed). For example, if the FF value is "0", it is set to "1". The record is therefore added to the favorite list LSF, and the favorite mark in the basic window is changed from the non-addition mark FMn (while circle) to the addition mark FMa (black circle) to thereby notify the user of an addition of the record to the favorite list LSF.

If the selected record has already been added to the favorite list LSF and the favorite flag FF value is "1", then the FF value is reset to "0". The record is deleted from the favorite list LSF, and the favorite mark in the basic window is changed from the addition mark FMa (black circle) to the non-addition mark FMn (white circle) to notify the user of a removal of the record from the favorite list LSF.

After the selected record in the basic window is added to or deleted from the favorite list LSF at Step S9, the flow advances to Step S10. If the favorite addition switch ST0 is not operated, the flow skips from Step S8 to Step S10. At Step S10 it is judged whether the first or second search window display switch SM5 or ST5 is operated to display a search window. If operated, the basic window (FIG. 5) on the display panel DP of the display device 13 is changed to a search window (FIG. 9). The first or second search list is formed at Steps S11 to S14 to thereafter advance to Step S15 (FIG. 7C). If not operated at Step S10, the flow directly advances to Step S15.

[2] List Generation

At Step S11 the mode enters the search mode in which a search window is displayed on the display panel DP of the display device 13 to prompt the user to enter the search conditions. FIG. 9 shows the correspondence between the display panel and the functions of display operation switches when a search list is formed. For example, if the first search list is to be formed, the first search window display operation switch SM5 is operated to display the first search window such as shown in FIG. 9 on the display panel DP. When the second search window display operation switch ST5 is operated, the second search window similar to that shown in FIG. 9 is displayed on the display panel DP. After the search conditions are entered from the search window, the search process is executed at Steps S12 to S14 to form the first or second search list LS1 or LS2.

In the search mode at Steps S11 to S14, the display panel DP is used for displaying a search window. As shown in FIG. 9, search condition display boxes SK1 to SK5 are formed in the central area of the search window in order to display various search conditions such as music title, genre, rhythm, tempo and keyword. The display operation switches SM0 to SM5 and ST1 to ST4 are used as search operation switches for the search window. In order to facilitate the operation of each switch, marks for guiding the operations of the search operation switches SM0 to SM5 and ST1 to ST4 are displayed near respective operation switches.

More in detail, in the style search mode, the operation switches SM0 to SM4 are used as search condition item designating switches when the search conditions including search terms of the music title, genre, rhythm, tempo (range) and keyword are to be entered. The operation switches ST1 to ST4 are used as search list selection switches for selecting a search list of records including the all-list LSA, favorite list LSF, first and second search lists LS1 and LS2. The operation switch SM5 is used as a search start switch.

At the next Step S12, the search conditions are input. According to one of the search condition input methods, when one of the search condition item designating switches SM0 to SM4 is operated, a pop-up input window is displayed in the search window for entering search condition data for the search condition item corresponding to the operated switch SM0 to SM4. The search condition data for the search condition item is then input (either as a character string or already prepared search condition data is selected) by operating a predetermined display operation switch or switches assigned for entering search condition data in the pop-up input-window.

When an OK button of the input window is operated, the input search condition data is displayed in the search condition display box SK1 to SK5 corresponding to the search condition item. This operation is sequentially performed for each search condition item to set the search condition data as illustratively shown in the search condition display boxes SK1 to SK5 shown in FIG. 9. If any one of the search condition display boxes is blank, it is assumed that there is no search condition for the blank search condition item.

If any one of the list selection switches ST1 to ST4 is operated at Step S12, the target search list of records can be selected. Namely, if any one of the list selection switches ST1 to ST4 is operated, the all-list LSA, favorite list LSF, first or second search list LS1 or LS2 corresponding to the operated list selection switch can be selected. If the list selection switches ST1 to ST4 are not operated, the all-list is set as the target search list.

If the first search list selection switch ST3 is operated to use the same search list as the first search list now under display, then the range of the old search list formed under the old search conditions can be narrowed by the new search conditions to form a new search list.

At Step S12, the input search condition data is stored in the first or second search condition buffer BF1 or BF2 (FIG. 2) corresponding to the operation of the first or second search window display operation switch SM5 or ST5.

At Step S13 it is judged whether there is a search start instruction by the search start switch SM5. If there is a search start instruction, the flow advances to a search routine at Step S14. Namely, as the user completes the settings of the search conditions and operates the search start switch SM5, the search process is executed in accordance with the set search conditions, whereas if there is no search start instruction, the flow returns to Step S12.

[Example of Search Process]

FIG. 8 is a flow chart showing an example of the search routine. In the search routine at Step S14, the record satisfying the set search conditions can be automatically searched in accordance with the search routine shown in the flow chart of FIG. 8. When the search routine starts, at a first Step R1 records satisfying the search condition data are derived from the target search list of records by referring to the contents of the first or second search condition buffer BF1 or BF2.

More specifically, as the contents stored in the search condition buffer BF1 or BF2 corresponding to the search list designated by the search window display operation switch SM5 or ST5 (FIG. 5), the all-list LSA, favorite list LSF, first search list LS1 or second search list LS2 is set as the search target list and the search condition data for each search condition item is set. Therefore, at Step R1, the record in the search target list satisfying the set search condition data is searched.

At the next Step R2, a search list constituted of the searched records is generated. If the target search list is the favorite list LSF, first search list LS1, second search list LS2 or the like, first, the entity (records) of the target search list is generated, and then the generated entity list (records) are searched. In this case, if the target search list (e.g., first search list) has the same list name (e.g., first search list) as the search list to be generated (i.e., if the target search list has already been generated), the records of the old search list are derived (generated) under the old search conditions and these derived records are searched under the new search conditions.

After the search list is generated by the above operation, at Step R3 the display on the display panel DP is switched to the search list window (basic window) to display the search list generated at Step R2 to thereafter terminate the search process and advance to Step S15 (FIG. 7C). After the search process is completed, the list (e.g., first search list shown in FIG. 9) generated by the search process is displayed on the list display panel DP as the basic window.

[3] List Switching Process

At Steps S15 to S20 of the style search process, in response to a list selection operation for the basic window on the list display panel DP, the list to be displayed in the basic window is switched between the all-list LSA, favorite list LSF, first search list LS1 and second search list LS2.

In order to change the list displayed in the basic window, the list selection switches ST1 to ST4 (FIG. 5) are operated. As described earlier, these switches are disposed on the operation panel in correspondence with the tabs LT of the lists in the basic window. The operations of these switches are sequentially detected at Steps S15, S17 and S19 and the corresponding list display operations are performed at Steps S16, S18 and S20, respectively. The display layouts of the basic windows of the lists are all generally the same, excepting the contents displayed on the list display DP. The contents of each of the lists LSA, LSF, LS1 and LS2 selected by the selection switches ST1 to ST4 are the records.

More specifically, at Step S15 it is judged whether the all-list selection switch ST1 is operated to instruct to display the all-list. If instructed, at Step S16 the contents of all the records stored in the record database DBR are displayed on the list display panel DP as the all-list LSA.

At Step S17 it is judged whether the favorite list selection switch ST2 is operated to instruct to display the favorite list LSF. If instructed, at Step S18 the records with the favorite flag FF of "1" (records added to the favorite list LSF) are derived from the all-list LSA and a favorite list LSF of derived records is temporarily generated and displayed on the list display panel DP. The records of the favorite list LSF generated at Step S18 are deleted from RAM 4 when another list is instructed to be displayed (i.e., when displaying the favorite list is terminated).

At Step S19 it is judged whether the first or second list selection switch ST3 or ST4 is operated to instruct to display the first or second list LS1 or LS2. If instructed, at Step S20 the search process (FIG. 9) similar to the process at Step S14 is executed. Namely, the search conditions are read from the search condition buffer BF1, BF2 corresponding to the operated list operation switch ST3, ST4 and a corresponding search list is temporarily generated to display the generated first or second search list on the list display panel DP.

Similar to the favorite list process at Step S18, the records of the search list LS1, LS2 generated at Step 20 are deleted from RAM 4 when another list is instructed to be displayed (i.e., when displaying the search list is terminated). The search condition data stored in the first or second search condition buffer BF1 or BF2 in RAM 4 is maintained as "old search conditions" until a new first or second search list is formed. After Step S20, the flow advances to Step S21. If any list selection operation is not performed, the judgement Steps S15, S17 and S19 are negated and the flow advances to Step S21.

At Step S21 other processes are executed. The other processes may be a sort process of sorting records of a list displayed in the basic window on the list display panel DP, an automatic accompaniment process such as an automatic accompaniment start and end and a section switching.

In response to an operation of the sort switch SM0 (FIG. 5), the display items (music title, style, genre, rhythm, tempo and the like) of a list displayed in the basic window are sorted. The display items are sorted, for example, toward the right side, e.g., music title→ style→ genre→ . . . The sorting is performed in accordance with a rule specific to each display item. As the sorting method, a general sorting method is used basically. For example, character strings are sorted in the character code order, quantities are sorted in the ascending or descending order, and the like. If there are quantities of the same order, the quantities are sorted with the priority of the order of the left side display items.

In response to an operation of the style reproduction switch of the operation unit 12, the automatic accompaniment starts. The automatic accompaniment is performed in accordance with the performance mode and style data set at Steps S3 and S7. For example, as the automatic accompaniment starts, the style data stored in the read buffer in RAM 4 is sequentially read in response to section switching and the like to perform the automatic accompaniment. This automatic accompaniment can be stopped by operating again the style reproduction switch.

After the other processes, the flow advances to Step S22 whereat it is judged whether an end of the style search function is instructed by an operation of the style search end switch of the operation unit 12. If there is no end instruction, the flow returns to Step S1 to repeat the processes at Steps S1 to S21 until there is an end instruction of the style search function. Upon reception of the end instruction, the style search process is terminated.

[Other embodiments]

Although the invention has been described with reference to the embodiment, the invention can be embodied in various styles. For example, in the embodiment, although each record contains the style number in order to identify the corresponding style data, a correspondence table between record identification numbers and style numbers may be used.

In the search process, a plurality of lists may be selected at a time as the target search lists. In this case, records satisfying the search conditions are derived from all records contained in the selected lists.

As in this embodiment, only the favorite flag FF and search conditions (BF1, BF2) are stored as the data representative of a list. This arrangement is preferable in terms of a storage capacity. A finer process is required in some cases. If the contents of derived records may be stored in a list, switching between lists to be displayed can be made fast because the search operation is not necessary before the list is displayed.

Although the special cursor motion is used only for genres, it may be used for music titles, rhythms, tempos or style names. Instead of moving the cursor to the top record among the records having the same genre, the cursor may be moved to the nearest record.

In the embodiment, although the normal and special cursor motion operation switches are used separately, the same switch may be used by changing its function.

The favorite addition switch for adding a record to the favorite list may be provided for each record displayed on the list display panel. For example, the switch is used for operating the favorite mark indicated by a circle at the left end of each record to add or delete the record to or from the favorite list.

The format of performance data may be any type such as an "event +relative time" type which indicates an occurrence time of a performance event by a time from the preceding event, an "event +absolute time" type which indicates an occurrence time of a performance event by an absolute time in music or a measure, a "pitch (rest)+length" type which represents performance data by the pitch and length of a note and the rest and length, and a "direct" type which reserves a memory field corresponding to a minimum resolution of performance data and stores a performance event in the memory field corresponding to the occurrence time of a performance event.

Control programs such as a performance data search process program and various data used for a performance data search process or the like may be supplied from an external storage medium or from an external apparatus via a communication interface, to a performance data search system made of an electronic musical instrument and a personal computer. The communication interface and communication network are not limited to wired interface and network but they may be wireless interface and network. Both wired and wireless interfaces and networks may be used.

The present invention has been described in connection with the preferred embodiments. The invention is not limited only to the above embodiments. It is apparent to those skilled in the art that various modifications, improvements, combinations, and the like can be made.

What we claim are:

1. A performance data search system for an automatic musical accompaniment apparatus, comprising:

a performance data storage device that stores a plurality of records and performance data settable to music;

a presenting device which presents a group of records stored in said performance data storage device; and a data reader which reads the performance data corresponding to a record selected from the presented group of records, wherein each of the records contains a music title, at least two of the records in the presented group of records contain the same music title, and different performance data are associated with the records having same music title, and wherein the performance data is an accompaniment data for playing the automatic musical accompaniment apparatus.

2. The performance data search system according to claim 1, wherein the record each have a plurality of items representative of setting information of music.

3. The performance data search system according to claim 2, wherein the plurality of items include music title and a music genre.

4. The performance data search system according to claim 1, wherein the group of records is formed by collecting records added with specific information.

5. The performance data search system according to claim 4, wherein the specific information indicates that the record was selected by a user.

6. The performance data search system according to claim 1, wherein the group of records is formed by collecting records satisfying search conditions.

7. The performance data search system according to claim 6, wherein selecting one of plural sets of search conditions stored indicates selecting a group of records.

8. The performance data search system according to claim 6, wherein a record group to be searched is selected from already existing record groups.

9. The performance data search system according to claim 1, further including a first operation unit for selecting a next record in the order of records in the list and a second operation unit for selecting a record having different contents in a particular item of the record, in the order of records in the list, wherein data reader reads performance data corresponding to the record selected by said first or second operation unit.

10. The performance data search system as claimed in claim 9, wherein the accompaniment data includes at least one of introduction data, main data, fill-in data and ending data.

11. The performance data search system as claimed in claim 1, wherein the performance data comprises MIDI data.

12. The performance data search system as claimed in claim 1, wherein the accompaniment data includes at least one of introduction data, main data, fill-in data and ending data.

13. A storage medium storing a program executable by a computer for executing a performance data search for an automatic musical accompaniment apparatus, the program comprising instructions for:

storing a plurality of records and performance data settable to music in a performance data storage device;

presenting a group of records stored in the performance data storing device; and reading performance data corresponding to a record selected from the presented group of records, wherein each of the records contains a music title, at least two of the records in the presented group contain the same music title, and different performance data are associated with the records having the same music title, and wherein the performance data is an accompaniment data for playing the automatic musical accompaniment apparatus.

14. The storage medium as claimed in claim 13, wherein the performance data comprises MIDI data.

15. The storage medium as claimed in claim 13, wherein the accompaniment data includes at least one of introduction data, main data, fill-in data and ending data.

* * * * *